US008246328B1

(12) United States Patent
Howell et al.

(10) Patent No.: US 8,246,328 B1
(45) Date of Patent: Aug. 21, 2012

(54) SEAL SECTION WITH SAND TRENCH

(75) Inventors: Alan Howell, Oklahoma City, OK (US); Michael Barnes, Yukon, OK (US); Randy Karbs, Edmond, OK (US); Arcady Royzen, Norman, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 710 days.

(21) Appl. No.: 12/350,297

(22) Filed: Jan. 8, 2009

Related U.S. Application Data

(60) Provisional application No. 61/131,703, filed on Jun. 12, 2008.

(51) Int. Cl.
*F04B 17/00* (2006.01)
*F04B 35/04* (2006.01)

(52) U.S. Cl. ..... 417/423.9; 417/424.2

(58) Field of Classification Search ..... 417/423.9, 417/424.2, 410; 166/105.3, 105.4, 107
See application file for complete search history.

(56) References Cited

U.S. PATENT DOCUMENTS

| | | | | |
|---|---|---|---|---|
| 5,367,214 | A * | 11/1994 | Turner, Jr. | 310/87 |
| 6,602,059 | B1 * | 8/2003 | Howell et al. | 417/423.3 |
| 6,666,664 | B2 * | 12/2003 | Gross | 417/423.3 |
| 7,048,046 | B1 * | 5/2006 | Sakamoto | 166/105 |
| 7,344,356 | B1 * | 3/2008 | Howell et al. | 415/174.2 |
| 7,367,400 | B1 * | 5/2008 | Howell | 166/310 |
| 2005/0087343 | A1 * | 4/2005 | Du et al. | 166/369 |
| 2007/0277969 | A1 * | 12/2007 | Hall et al. | 166/105 |

* cited by examiner

*Primary Examiner* — Mariceli Santiago
*Assistant Examiner* — Glenn Zimmerman
(74) *Attorney, Agent, or Firm* — Crowe & Dunlevy

(57) ABSTRACT

A seal section for use with a downhole pumping system includes a rotatable shaft, a seal section head and a mechanical seal chamber inside the seal section head. The mechanical seal chamber is bounded by a floor and a wall. The mechanical seal chamber includes a trench disposed in the floor that is configured to entrap solid particles in the mechanical seal chamber at a distance spaced apart from the mechanical seal.

12 Claims, 4 Drawing Sheets

SEAL SECTION WITH SAND TRENCH

RELATED APPLICATIONS

The present application claims the benefit of U.S. Provisional Patent Application No. 61/131,703, entitled 'Mechanical Seal Trash Trench," filed Jun. 12, 2008.

FIELD OF THE INVENTION

This invention relates generally to the field of submersible pumping systems, and more particularly, but not by way of limitation, to the protection and preservation of mechanical seals used in downhole electrical submersible pumping systems.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. In many submersible pumping systems, rotating shafts are used to transfer power from the prime mover to output devices like gas separators and pump assemblies. Each of the components and sub-components in a submersible pumping system must be engineered to withstand the inhospitable downhole environment, which includes wide ranges of temperature, pressure and corrosive well fluids.

Submersible pumping systems can also include seal sections connected between the motor and the pump assembly. The seal section protects the motor from well fluids and thrust forces generated by the operation of the motor and pump. During operation, the motor produces heat that is in part dissipated into circulating lubricant. Thermal expansion causes the volume of the lubricant to increase at elevated temperatures. To prevent the accumulation of pressure within the motor, lubricant is vented into the adjacent lubricant filled seal section. As the motor cools, the motor lubricants contract and well fluids are drawn into the seal section to replace the volume of motor lubricant that returned to the motor. As fluids exchange place in the seal section, the motor oil may become contaminated by mixing with the well bore fluid.

Mechanical seals are commonly used to prevent the migration of well bore fluid along the rotating shafts. Generally, a mechanical seal includes components that provide a structural barrier against fluid migration. A popular design of mechanical seals employs a spring on the exterior of the mechanical seal that exerts axial force on components of the mechanical seal. The spring keeps the components of the mechanical seal in proper position to keep the well bore fluids from migrating along the shaft.

Turning to FIG. 1, shown therein is a PRIOR ART seal section 212 of the type disclosed in U.S. Pat. No. 7,344,356, entitled "Mechanical Seal With Bellows Seating Alignment," issued Mar. 18, 2008 and commonly assigned with the present application. The PRIOR ART seal section 212 includes a head 214 configured for attachment to a pump assembly (not shown), a base 216 configured for attachment to a motor assembly (not shown), a rotating shaft 226 and a plurality of mechanical seals 224*a*, 224*b*, 224*c* and 224*d* disposed within the seal section 212 at various points along the rotating shaft 226. The head 214 includes a mechanical seal chamber 238 that houses the uppermost mechanical seal 224*a*.

While generally acceptable, the PRIOR ART design depicted in FIG. 1 may be susceptible to failure in certain environments. As wellbore fluids are drawn into the seal section 212, sand and other particulate solids may collect in the mechanical seal chamber 238 in the proximity of the mechanical seal 224*a*. Contamination with solid particles degrades the performance characteristics of the mechanical seal spring and compromises the sealing surfaces of the mechanical seal, resulting in a failure of the mechanical seal.

Accordingly, there exists a need for an improved design that is more resistant to contamination and wear caused by solid particles. It is to this and other deficiencies in the prior art that the present invention is directed.

SUMMARY OF THE INVENTION

In a preferred embodiment, the present invention includes a seal section for use with a downhole pumping system. The seal section includes a rotatable shaft, a seal section head and a mechanical seal chamber inside the seal section head. The mechanical seal chamber is bounded by a floor and a wall. The mechanical seal chamber includes a trench disposed in the floor that is configured to entrap solid particles in the mechanical seal chamber at a distance spaced apart from the mechanical seal.

DETAILED DESCRIPTION OF THE PREFERRED EMBODIMENTS

Figure 1:
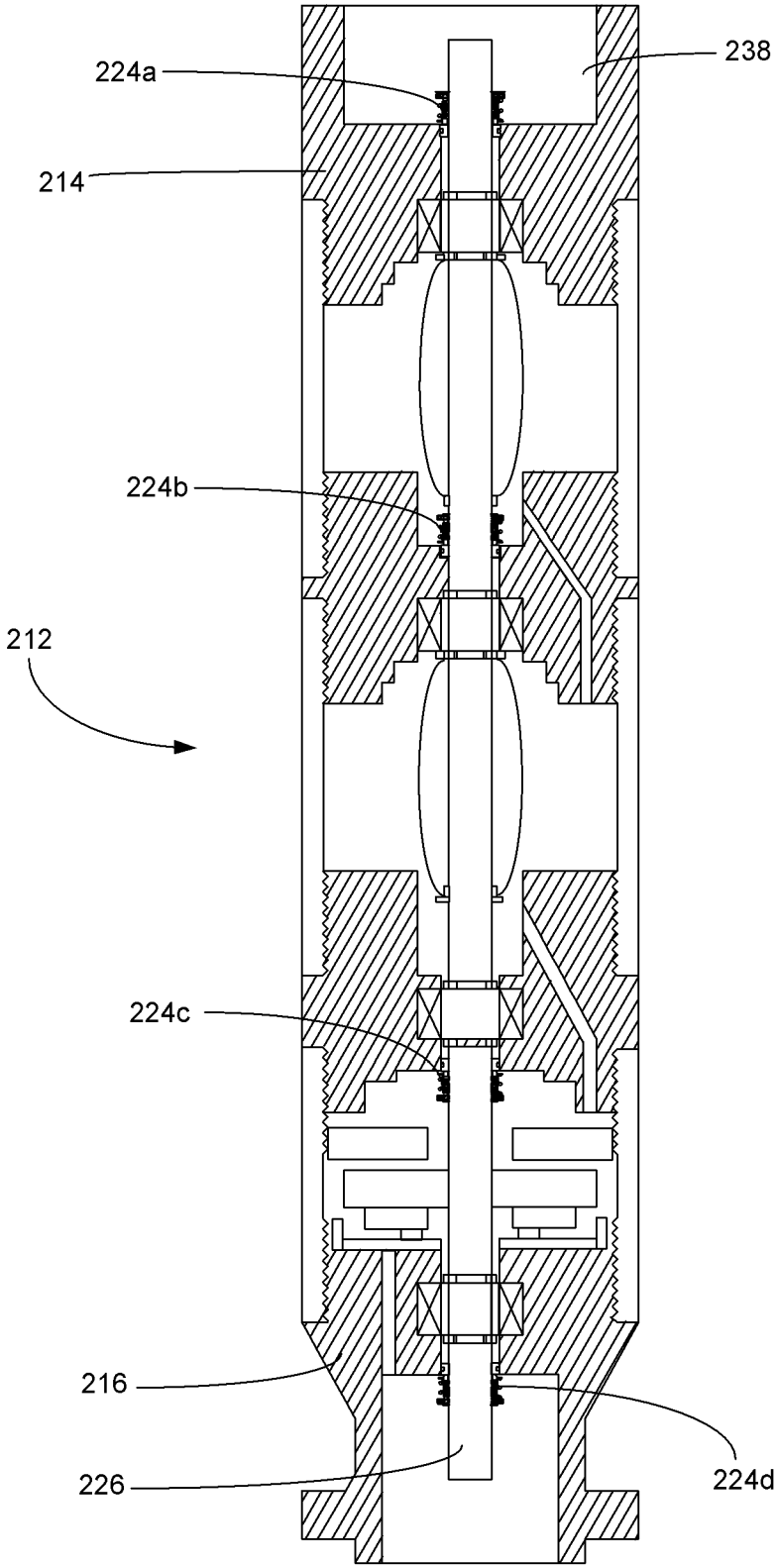
PRIOR ART FIG. 1
FIG. 1 is a cross-sectional view of a PRIOR ART seal section.
Figure 2:
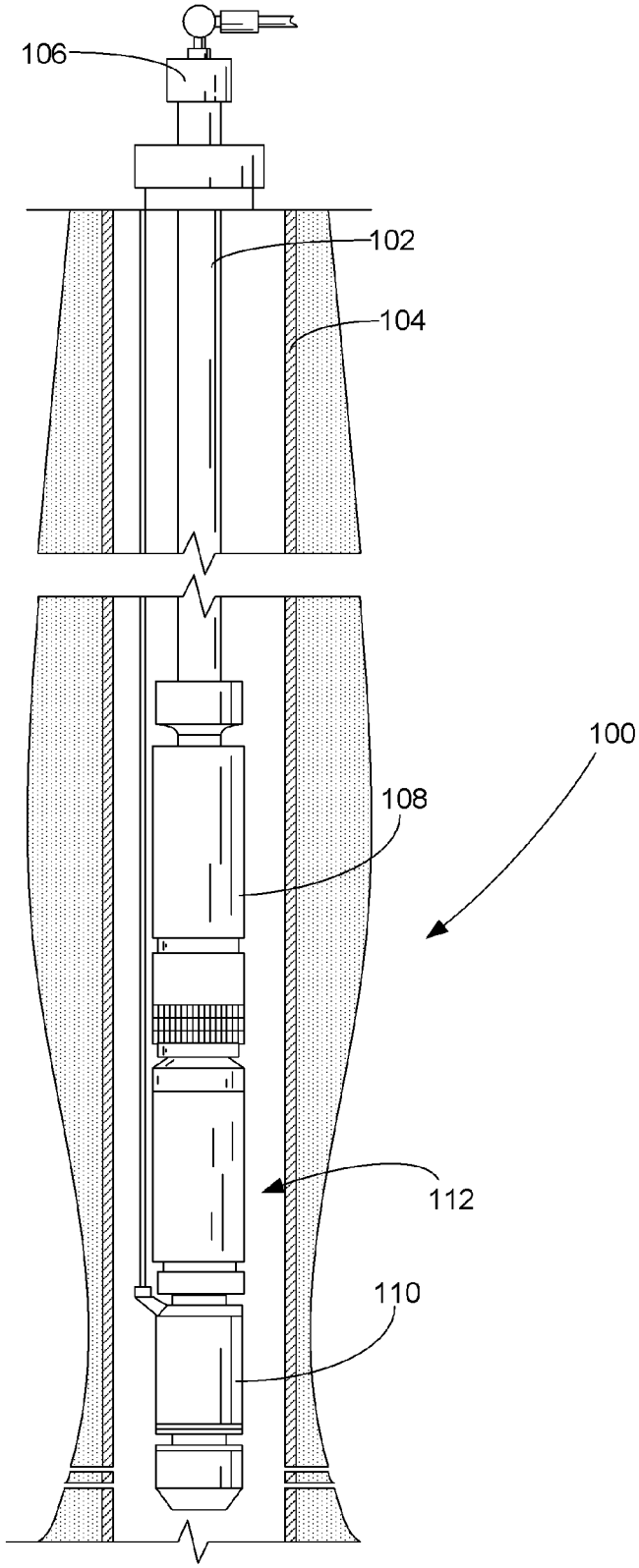
FIG. 2 is an elevational depiction of an electrical submersible pumping system constructed in accordance with a preferred embodiment of the present invention.

In accordance with a preferred embodiment of the present invention, FIG. 2 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The pumping system 100 preferably includes some combination of a pump assembly 108, a motor assembly 110 and a seal section 112. The motor assembly 110 is preferably an electrical motor that receives power from a surface-mounted motor control unit (not shown). When energized, the motor assembly 110 drives a shaft that causes the pump assembly 108 to operate. The seal section 112 shields the motor assembly 110 from mechanical thrust produced by the pump assembly 108 and provides for the expansion of motor lubricants during operation. The seal section 112 also isolates the motor assembly 110 from the wellbore fluids. The seal section 112 includes a housing (not separately designated) configured to protect the internal components of the seal section 112 from the exterior wellbore environment. It may be desirable to use tandem-motor combinations, multiple seal sections, multiple pump assemblies or other downhole components not shown in FIG. 2.

Figure 3:
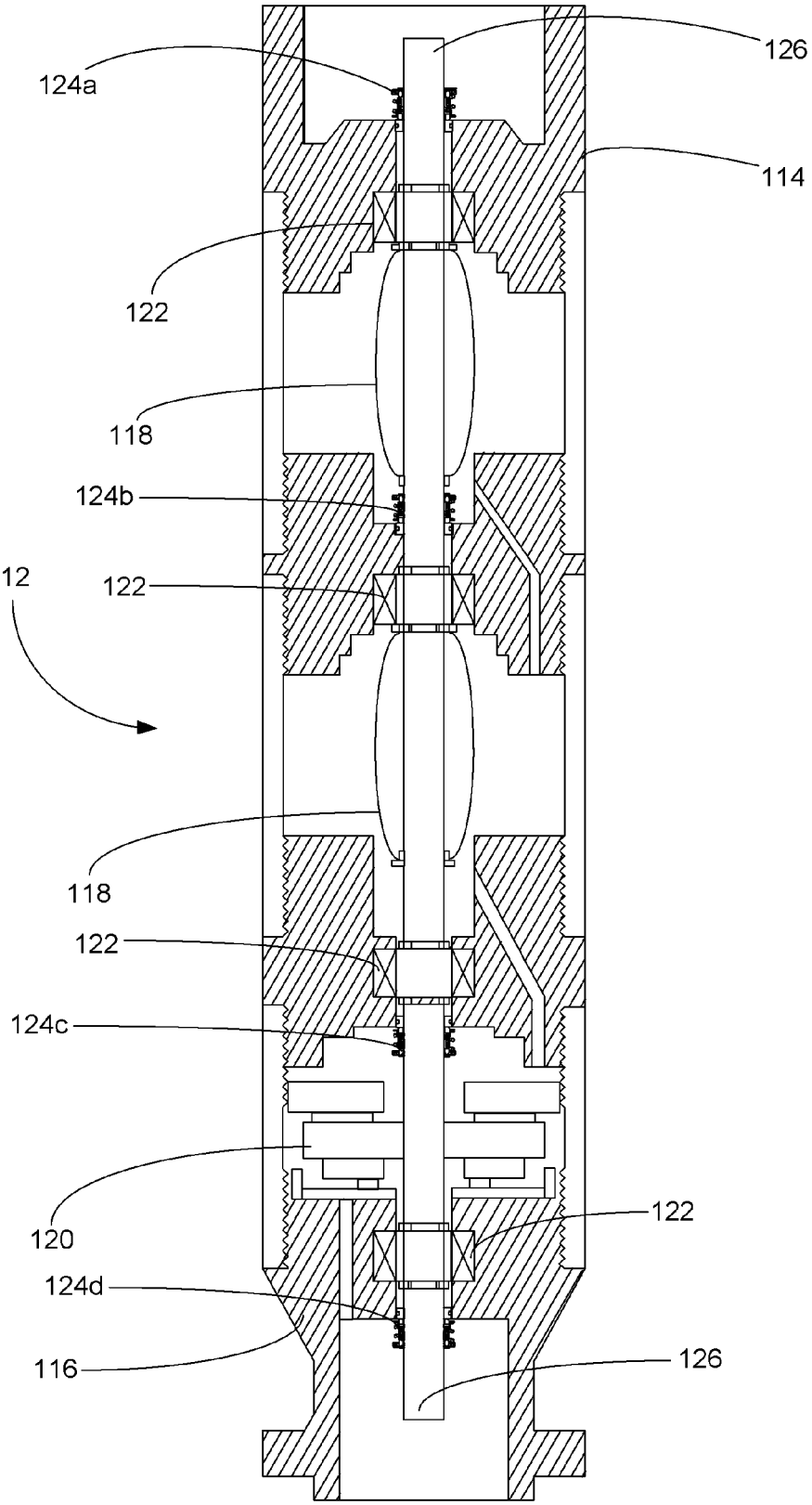
FIG. 3 is a cross-sectional view of a seal section of the submersible pumping system of FIG. 2, constructed in accordance with a preferred embodiment of the present invention.

Turning to FIG. 3, shown therein is a cross-sectional view of the seal section 112 constructed in accordance with a presently preferred embodiment. The seal section 112 includes a head 114 configured for connection to the pump assembly 108 (not shown in FIG. 3), a base 116 configured for connection to the motor assembly 110 (not shown in FIG. 3), a plurality of elastomer seal bags 118, thrust bearings 120, a plurality of support bearings 122, a plurality of mechanical seals 124*a*, 124*b*, 124*c* and 124*d*, and a rotatable shaft 126.

Thrust bearings 120 are used to control the axial displacement of the shaft 126. Support bearings 122 control the lateral position of the shaft 126. In the presently preferred embodiments, the thrust bearings 120 and support bearings 122 are configured as hydrodynamic bearings and constructed using industry-recognized oil-impregnated bearing materials. The elastomer seal bags 118 are configured to prevent the contamination of clean motor lubricants with wellbore fluids. The mechanical seals 124*a*-124*d* are positioned at various points along the shaft 126 and limit the migration of fluid along the shaft 126.

Figure 4:
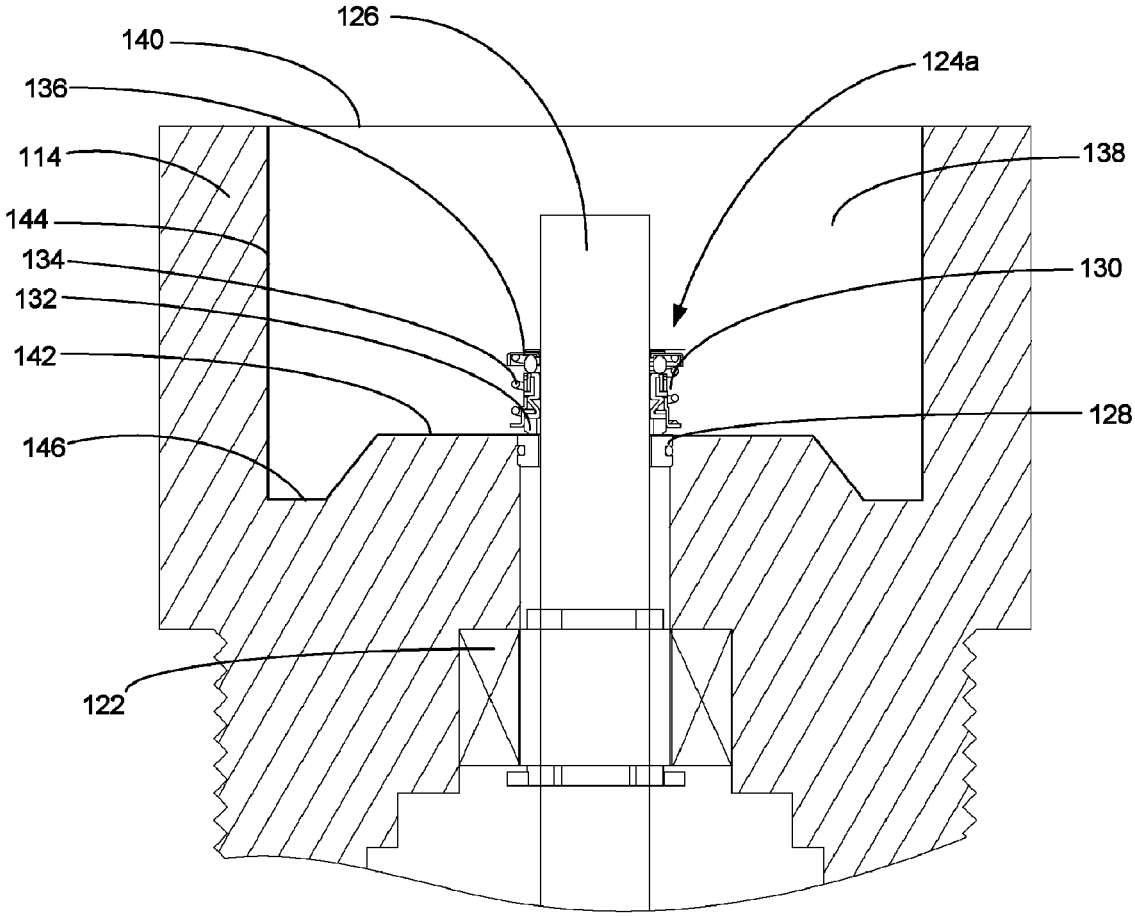
FIG. 4 is a close-up cross-sectional view of the head of the seal section of FIG. 3.

Turning to FIG. 4, shown therein is a close-up view of the head 114 of the seal section 112. Each mechanical seal 124*a*-124*d* generally includes a stationary ring 128 and a rotation portion 130. The stationary ring 128 is fixed in position inside the head 114 and does not rotate with the shaft 126. The rotation portion 130 is fixed to the shaft 126 and rotates with respect to the stationary ring 128. The rotation portion 130 preferably includes a runner 132, a spring 134 and a retainer ring 136. The running faces of the runner 132 and stationary ring 128 are held in contact by the spring 134, which exerts a compressive force between the retainer ring 136 and runner 132.

The head 114 includes a mechanical seal chamber 138 that is configured to house the mechanical seal 124*a*. The mechanical seal chamber 138 is generally configured as a void in the head 114, bounded by an open end 140, a floor 142 and a substantially cylindrical wall 144. The mechanical seal chamber 138 includes a trench 146 disposed at in the floor 142. The trench 146 is constructed as a recessed groove in the floor 142. The trench 146 preferably extends below the running faces of the mechanical seal 124*a*. In a presently preferred embodiment, the trench 146 is located at the periphery of the floor 142 adjacent the wall 144.

During operation, the rotation portion 130 of the mechanical seal 124*a* rotates with the shaft 126. As the rotation portion 130 spins, it will sling any sand or other solid particles outward toward the wall 144 of the mechanical seal chamber 138. As the solid particles are propelled outward, gravity will pull the particles downward into the trench 146. Unlike prior art designs, the solid particles become captured in the trench 146 and are prevented from interfering with the performance of the mechanical seal 124*a*. In this way, the trench 146 entraps solid particles in the mechanical seal chamber 138 at a distance spaced apart from the mechanical seal 124*a*. Over an extended period of time, the trench 146 may eventually fill with trapped solid particles and the trench 146 will lose its ability to prevent the solid particles from interfering with the mechanical seal 124*a*. Nonetheless, the time required to fill the trench 146 significantly extends the operational life of the mechanical seal 124*a*.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A seal section for use with a downhole pumping system, the seal section comprising:
- a rotatable shaft;
- a seal section head; and
- a mechanical seal chamber inside the seal section head, wherein the mechanical seal chamber includes a floor, a wall and a trench, wherein the trench is recessed within the floor and spaced apart from the rotatable shaft.

2. The seal section of claim 1, further comprising a mechanical seal located inside the mechanical seal chamber, wherein the mechanical seal includes a rotation portion connected to the rotatable shaft and a stationary portion connected to the seal section head.

3. The seal section of claim 2, wherein the trench is disposed along the periphery of the floor adjacent the wall.

4. The seal section of claim 3, wherein the trench extends below the stationary portion of the mechanical seal.

5. The seal section of claim 4, wherein the rotation portion of the mechanical seal further comprises a runner, a spring and a spring retainer.

6. The seal section of claim 5, further comprising:
- a plurality of elastomeric seal bags;
- thrust bearings; and
- a plurality of support bearings.

7. A pumping system configured for use in a downhole application, the pumping system comprising:
- a motor assembly;
- a pump assembly; and
- a seal section disposed between the motor assembly and the pump assembly, wherein the seal section comprises:
  - a rotatable shaft;
  - a seal section head; and
  - a mechanical seal chamber inside the seal section head, wherein the mechanical seal chamber includes a floor, a wall and a trench, wherein the trench is recessed within the floor and spaced apart from the rotatable shaft.

8. The pumping system of claim 7, wherein the seal section further comprises a mechanical seal located inside the mechanical seal chamber, wherein the mechanical seal includes a rotation portion connected to the rotatable shaft and a stationary portion connected to the seal section head.

9. The pumping system of claim 8, wherein the trench is disposed along the periphery of the floor adjacent the wall.

10. The pumping system of claim 9, wherein the trench extends below the stationary portion of the mechanical seal.

11. The pumping system of claim 10, wherein the rotation portion of the mechanical seal further comprises a runner, a spring and a spring retainer.

12. A seal section for use with a downhole pumping system, the seal section comprising:

a rotatable shaft;

a seal section head;

a mechanical seal chamber inside the seal section head;

a mechanical seal inside the mechanical seal chamber; and means for entrapping solid particles in mechanical seal chamber at a distance spaced apart from the mechanical seal.

* * * * *